US008231486B2

(12) United States Patent
Neufeld

(10) Patent No.: US 8,231,486 B2
(45) Date of Patent: Jul. 31, 2012

(54) HOCKEY STICK BLADE

(76) Inventor: Gregory D. Neufeld, Spruce Grove (CA)

( * ) Notice: Subject to any disclaimer, the term of this patent is extended or adjusted under 35 U.S.C. 154(b) by 192 days.

(21) Appl. No.: 12/876,398

(22) Filed: Sep. 7, 2010

(65) Prior Publication Data

US 2012/0058843 A1 Mar. 8, 2012

(51) Int. Cl.
*A63B 59/14* (2006.01)

(52) U.S. Cl. ..... 473/563

(58) Field of Classification Search ..... 473/560–563, 473/446

See application file for complete search history.

(56) References Cited

U.S. PATENT DOCUMENTS

| | | | | |
|---|---|---|---|---|
| 3,489,412 | A | 1/1970 | Franck et al. | |
| 3,563,546 | A * | 2/1971 | Dawe | 473/563 |
| 4,343,468 | A | 8/1982 | Lindgren | |
| 4,452,451 | A * | 6/1984 | Dubreuil | 473/563 |
| 4,570,932 | A | 2/1986 | Cote | |
| 4,793,613 | A | 12/1988 | Hughes | |
| 5,078,396 | A | 1/1992 | Cavallaro et al. | |
| 5,582,405 | A * | 12/1996 | Montgomery | 473/563 |
| D380,243 | S | 6/1997 | Neufeld | |
| 6,471,609 | B1 | 10/2002 | Fell | |
| 7,294,072 | B2 | 11/2007 | Montecchia | |
| 2005/0070382 | A1 * | 3/2005 | Loschiavo | 473/563 |
| 2006/0270497 | A1 * | 11/2006 | Dehen | 473/563 |
| 2009/0253537 | A1 * | 10/2009 | Bremner | 473/446 |

* cited by examiner

*Primary Examiner* — Mark Graham
(74) *Attorney, Agent, or Firm* — Donald V. Tomkins

(57) ABSTRACT

A hockey stick blade assembly has forehand and backhand blade members with respective toe ends and heel ends, plus a bridging member interconnecting the two toe ends. The forehand member has a forehand contact face and a back face, and the backhand member has a backhand contact face and an inner face. The forehand member's heel end is attached or attachable to an elongate shaft. The backhand member's heel end lies closely adjacent to, and is preferably slidable relative to, the back face of the forehand member, creating a hollow zone bounded by the bridging member, the back face of the forehand member, and the inner face of the backhand member, and open at both its upper and lower ends. The blade assembly can be configured to provide any desired combination of forehand and backhand contact surface profiles.

15 Claims, 4 Drawing Sheets

HOCKEY STICK BLADE

FIELD OF THE INVENTION

The present invention relates in general to hockey sticks used in games such as ice hockey and street hockey.

BACKGROUND OF THE INVENTION

In ice hockey and similar games, players use bladed hockey sticks to maneuver a hockey puck (or other scoring piece, such as a ball) over the playing surface, such as for passing the puck to teammates, shooting the puck at the opposing team's goal (or net) in an effort to score a goal, and moving (or "carrying") the puck over the ice surface while retaining possession and control of the puck until it is necessary or desirable to pass it or shoot it.

A hockey player will typically be either a right-handed shooter or a left-handed shooter, and accordingly will use a right-handed stick or a left-handed stick, as appropriate. In either case, the face of the hockey stick blade that the player typically uses to carry the puck, for most passes, and for both "wrist shots" and "slap shots", is referred to as the forehand face. The other face of the blade is called the backhand face. Especially when moving the puck down the ice, a player will often alternate the puck's position between the forehand and backhand faces—a maneuver commonly referred to as "stick-handling"—to make it more difficult for opposing players to take the puck away.

Traditionally, hockey stick blades were flat, with substantially planar forehand and backhand faces. However, over the past fifty years or more, hockey sticks have also been made with curved blades, with the forehand face of the blade having a concave profile, and with the backhand face having a convex profile. This style of blade is advantageous for a number of reasons. Because of the concavity on the forehand face of the blade, the puck will tend to stay on the blade, rather than tending to roll toward one end of the blade, when a player is carrying the puck up the ice. When shooting the puck on the forehand, the concave forehand profile of the stick tends to center the puck on the blade, thus enhancing the player's ability to aim and shoot the puck with greater accuracy and force.

However, a conventional curved blade also has drawbacks. The convex profile of the backhand face of the blade makes the puck more prone to roll off the end of the blade when a player is stick-handling than would be the case using a straight-bladed stick. For similar reasons, the convex backhand face of the curved blade also makes it more difficult to control and accurately aim backhand shots. Because of such drawbacks, some players still prefer to use straight-bladed hockey sticks in order to have a reasonable if not optimal degree of puck control on both the forehand and the backhand.

The prior art discloses a variety of hockey stick blade designs directed to puck controllability on the forehand and/or the backhand. Examples of such prior art designs include:

U.S. Pat. No. 3,489,412 (Franck et al.);
U.S. Pat. No. 4,343,468 (Lindgren);
U.S. Pat. No. 4,570,932 (Cote);
U.S. Pat. No. 4,793,613 (Hughes);
U.S. Pat. No. 5,078,396 (Cavallaro et al.);
U.S. Pat. No. 6,471,609 (Fell);
U.S. Pat. No. 7,294,072 (Montecchia); and
U.S. Pat. No. Des. 380,243 (Neufeld).

What is needed is an improved hockey stick blade that provides puck controllability on both the forehand and the backhand, without requiring insert elements, blade bifurcations, or blade face fasciae (being examples of features found in various of the noted prior art designs), while also maintaining blade flexibility for optimal shooting and puck-carrying effectiveness. As well, there is a need for such hockey stick blades that, in addition to being manufactured in finished form, can also be produced by adaptation or retrofitting of conventional hockey stick blades. The present invention is directed to these needs.

BRIEF SUMMARY OF THE INVENTION

In general terms, the present invention teaches a blade for a hockey stick having a first blade member and a second blade member, and with a hollow space separating at least a portion of the first blade member from at least a portion of the second blade member. For convenience in this patent document, the first blade member will be alternatively referenced as the forehand blade member, and the second blade member will be alternatively referenced as the backhand blade member. However, persons skilled in the art will understand that the blade constructions described herein with reference to the forehand and backhand blade members can be reversed without departing from the scope and concept of the present invention.

The forehand and backhand blade members have respective outer ends (or "toe ends"), and a bridging member interconnects these two toe ends. The forehand blade member also has an inner end (or "heel end") connected to (or transitioning with) an elongate shaft, to be gripped and manipulated by a hockey player during use. The forehand blade member has a contact face (i.e., a surface intended to come into contact with a puck when maneuvering or shooting the puck) plus a back face. The backhand blade member also has a contact face and a back face, plus an inner end (or "heel end") disposed adjacent to the back face of the forehand blade member in a transition area selectively located between the a medial region of the forehand blade member and its heel end. This configuration results in the formation of a hollow zone bounded by the bridging member and the back faces of the forehand and backhand blade members, and open at both its upper and lower ends.

In some embodiments, the above-mentioned transition zone may be close to the heel end of the forehand blade member; in such embodiments, the contact face of the backhand blade member will constitute substantially the full backhand face of the blade assembly. In other embodiments, in which the transition zone is spaced from the heel end of the forehand blade member, the contact face of the backhand blade member transitions with the back face of the forehand blade member to create a combined or composite backhand contact surface. In any of these embodiments, the overall blade assembly can be configured to have a curved forehand contact surface and a generally planar backhand contact surface; a curved forehand contact surface and a curved backhand contact surface; planar forehand and backhand contact surfaces; or even a planar forehand contact surface and a curved backhand surface, as a player may desire.

In some embodiments, the heel end of the backhand blade member is free to slide relative to (and preferably but not necessarily in contact with) the back face of the forehand blade member, in a direction toward or away from the heel of the forehand blade member. This construction allows the forehand blade member to flex in substantially the same fashion as it would in absence of the backhand blade member.

Hockey stick blade assemblies in accordance with embodiments of the present invention may be manufactured as unitary blade units. Such unitary blade units may be made integral with hockey stick shafts, or they may be adapted for mounting to a separate shaft.

Alternatively, a blade assembly in accordance with the present invention may be formed by modifying a conventional hockey stick blade (curved or straight) by bonding or otherwise affixing a backhand adapter component (or "backhand adapter") to the back face of the blade. In this embodiment, the backhand adapter is an integral component incorporating the backhand blade member and the bridging member, and, in some variants, an auxiliary member contiguous with the bridging member, for effecting a bond or other connection with the back face of the blade.

The various components of hockey stick blade assemblies in accordance with the present invention may be formed from any suitable material or combination of suitable materials, including but not limited to wood (the most common material traditionally used for hockey sticks), aluminum, and synthetic materials such as fiberglass-reinforced plastic. Strong but lightweight materials such as carbon fiber are particularly advantageous for embodiments incorporating a backhand adapter bonded to a conventional blade, but can also be used for one or more components of blade assemblies manufactured as integral units.

Accordingly, in a first aspect, the present invention teaches a hockey stick blade assembly comprising: a forehand blade member having a heel end adapted for connection to an elongate shaft, a toe end, a forehand contact face, and a back face; a backhand blade member having a heel end, a toe end, a backhand contact face, and an inner face; and a bridging member having a first end connected to the toe end of the forehand blade member and a second end connected to the toe end of the backhand blade member; wherein the toe end of the backhand member is disposed adjacent the back face of the forehand blade member, thereby forming a hollow zone bounded by the bridging member, the back face of the forehand member, and the inner face of the backhand member, with the hollow zone being open at its upper and lower ends. The toe end of the backhand member may be slidable relative to the forehand blade member, in a direction toward or away from the heel end of the forehand blade member, or it may be non-slidably connected to the forehand blade member.

In one embodiment, the hockey stick blade assembly further comprises an auxiliary member having: a heel end; a toe end contiguous with the first end of the bridging member; an outer face; and an inner face; wherein the outer face of the auxiliary member is affixed to the back face of the forehand blade member.

In an alternative embodiment of the hockey stick blade assembly the back face of the forehand blade member defines a transition point where the thickness of the forehand blade member changes, so as to define a thickened zone adjacent to the transition point and extending toward the heel end of the forehand blade member; the thickness of the forehand blade member in a region extending from the transition point toward the toe end of the forehand blade member is less than the thickness of the thickened zone; a recess extends to a selected depth from the back face of the forehand blade member into the thickened zone, and extends laterally a selected distance from the transition point toward the heel end of the forehand blade member; and the heel end of the backhand blade member defines a tongue member disposed within the recess in the thickened zone, such that the tongue is slidable within the recess in a direction toward or away from the heel end of the forehand blade member.

In a second aspect, the present invention teaches a hockey stick comprising an elongate shaft and a hockey stick blade assembly as described herein, with the heel end of the forehand blade member of the hockey stick blade assembly being attached to the lower end of the elongate shaft.

In a third aspect, the present invention teaches a backhand adapter for mounting to the blade of a conventional hockey stick, comprising: a backhand blade member having a heel end, a toe end, a backhand contact face, and an inner face; an auxiliary member having a heel end, a toe end, an outer face, and an inner face; and a bridging member having a first end and a second end; wherein the first end of the bridging member is contiguous with the toe end of the backhand blade member; the second end of the bridging member is contiguous with the toe end of the auxiliary member; the backhand adapter is mountable to a hockey stick blade by affixing the outer face of the auxiliary member to a selected face of the hockey stick blade; and when the backhand adapter is mounted to the hockey stick blade, the heel end of the backhand blade member will lie adjacent to said selected face of the hockey stick blade.

BRIEF DESCRIPTION OF THE DRAWINGS

Embodiments of the invention will now be described with reference to the accompanying figures, in which numerical references denote like parts, and in which.

DETAILED DESCRIPTION

Embodiments with Backhand Adapter

Figure 1:
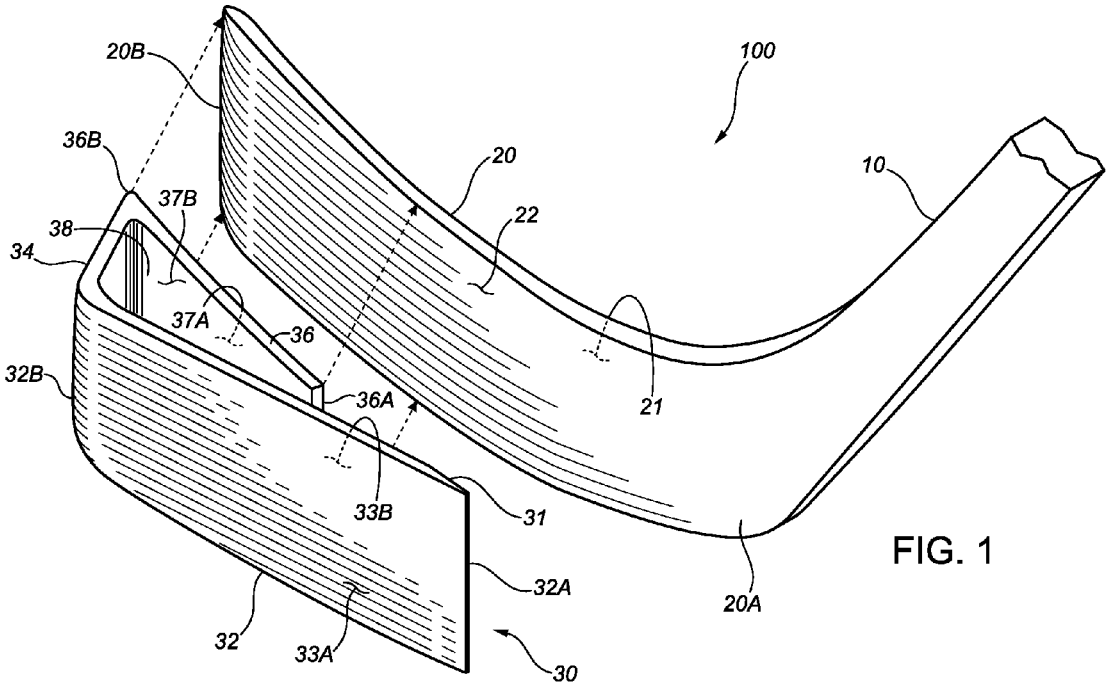
FIG. 1 is an exploded perspective view of a hockey stick blade assembly in accordance with a first embodiment of the present invention, comprising a backhand adapter and a conventional hockey stick blade.

FIG. 1 illustrates a hockey stick blade assembly 100 in accordance a first embodiment of the present invention. Blade assembly 100 comprises a first (or forehand) blade member 20 having an inner (or heel) end 20A mountable to or integral with the lower end of an elongate shaft 10, and an outer (or toe) end 20B. Forehand blade member 20 may comprise the curved or straight blade of a conventional hockey stick. Forehand blade member 20 has a first (or forehand) contact face 21 and a second (or back) face 22 (which would serve as a backhand contact face in a conventional hockey stick).

Provided in accordance with this embodiment is a backhand adapter 30 comprising: a backhand blade member 32 having an inner (or heel) end 32A, and an outer (or toe) end 32B, an outer (or backhand) contact face 33A and an inner face 33B; an auxiliary member 36 having an inner (or heel) end 36A, an outer (or toe) end 36B, an outer face 37A, and an inner face 37B; and a bridging member 34 having a first end 34A connected to toe end 32B of backhand blade member 32 and a second end 34B connected to toe end 36B of auxiliary member 36. As illustrated in the Figures, outer face 37A of auxiliary member 36 may be shaped for substantially mating contact with a region of back face 22 of forehand blade member 20, preferably (but not necessarily) proximal to toe end 20B of forehand blade member 20, to facilitate bonding of outer face 37A to back face 22, using a suitable adhesive material.

Figure 2:
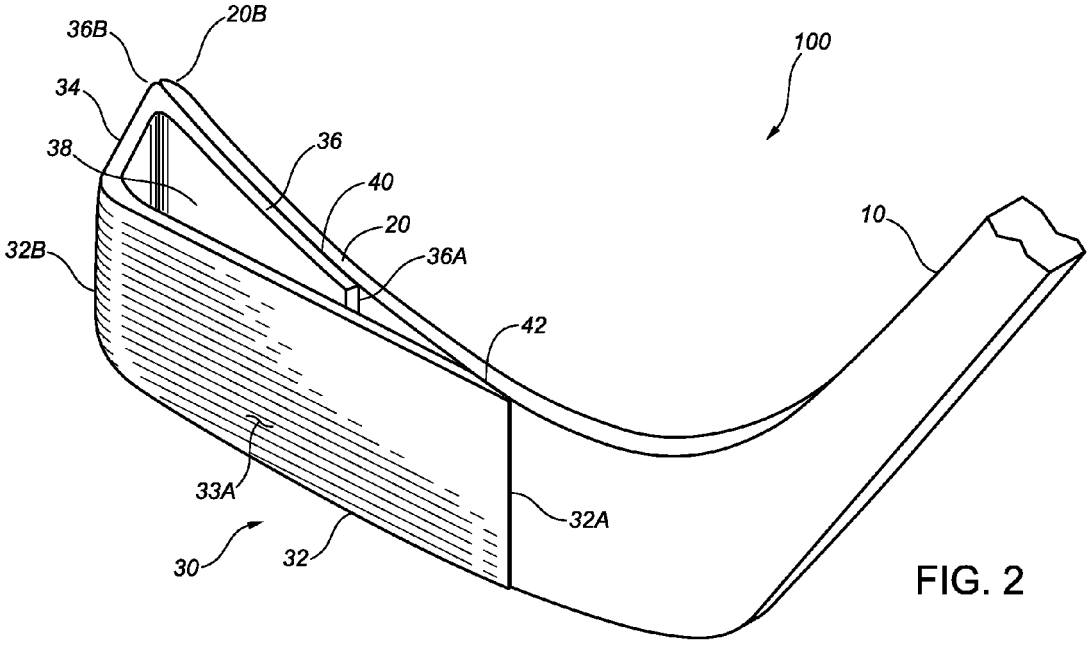
FIG. 2 is a perspective view of the embodiment in shown FIG. 1, fully assembled with the backhand adapter bonded to the conventional blade.
Figure 4:
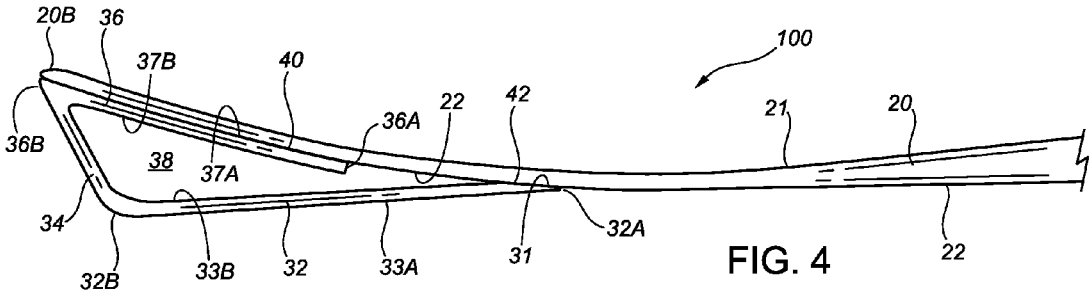
FIG. 4 is a plan view of the embodiment shown in FIG. 2.

FIGS. 2 and 4 show the finished blade assembly 100, with outer face 37A of auxiliary member 36 bonded to back face 22 of forehand blade member 20 along or over a first contact interface 40 formed by outer face 37A to back face 22, forming a hollow space 38 bounded by backhand blade member 32, an opposing portion of forehand blade member 20, and bridging member 34. Although the embodiment shown in FIGS. 1, 2, and 4 contemplates the use of adhesive to mount or affix auxiliary member 36 to backhand face 22 of forehand blade member 20, persons skilled in the art will appreciate that this can also be accomplished by various alternative known means, and the present invention is not limited to embodiments that use adhesive for this purpose. The length of auxiliary member 36 is a matter of design, and need only be long enough to facilitate a sufficiently firm connection (by adhesives or other means of attachment) to forehand blade member 20.

As best seen in FIGS. 2 and 4, when auxiliary member 36 has been mounted to forehand blade member 20 as described above, heel end 32A of backhand blade member 32 will preferably be disposed against or otherwise closely adjacent to back face 22 of forehand blade member 20. In combination, backhand contact face 33A of backhand blade member 32, in combination of a portion of back face 22 of forehand blade member 20 extending from heel end 32A of backhand blade member 32 toward heel end 20A of forehand blade member 20, will combine to form a composite backhand contact surface—which may be straight or curved, depending on the selected geometries of forehand blade member 20 and backhand blade member 32.

In some embodiments, heel end 32A of backhand blade member 32 is not connected to forehand blade member 20. This construction allows forehand blade member 20 to flex in substantially the same way as it would without the presence of auxiliary member 36. As forehand blade member 20 flexes, heel end 32A of backhand blade member 32 will simply slide along back face 22 of forehand blade member 20, and then elastically rebound to a neutral or unstressed position when the flexure in forehand blade member 20 is relaxed. However, this feature is not essential to the invention, and in alternative embodiments, heel end 32A of backhand blade member 32 may be connected to forehand blade member 20 in some non-sliding fashion (as might be desirable for players who prefer a comparative stiff blade).

Preferably, backhand blade member 32 will be reasonably thin (having due regard to minimum structural requirements), to facilitate a smooth transition between heel end 32A of backhand blade member 32 and back face 22 of forehand blade member 20. For this purpose, and as seen in FIGS. 1, 2, and 4, heel end 32B of backhand blade member 32 optionally may be bevelled or tapered, making backhand blade member 32 very thin at heel end 32A, and with a bevelled face 31 being formed on inner face 33B of backhand blade member 32 adjacent to heel end 32A, such that bevelled face 31 can slide along back face 22 of forehand blade member 20 as forehand blade member 20 flexes during use.

Backhand adapter 30 may be fabricated from carbon fiber or other synthetic material having comparatively light weight as well as structural strength suitable for the purpose. However, other materials may be used for backhand adapter 30 without departing from the scope or concept of the present invention. Whatever material or materials might be used for backhand adapter 30, and particularly for players who prefer a blade that has a lot of "flex" (to increase shot velocity), it may be desirable (though not essential) for auxiliary member 36 to be as thin as reasonably possible to minimize any decrease in the elastic flexibility of forehand blade member 20 consequent upon the mounting of auxiliary member 36 to forehand blade member 20.

Another optional (but non-essential) feature is for backhand blade member 32 to have a degree of elastic resilience, such that backhand blade member 32 can undergo some amount of elastic flexural deformation under reasonably forceful backhand shots, thus creating a transient concavity in backhand blade member 32 (over and above any concavity built into backhand blade member 32), thereby enhancing the player's ability to control and accurately aim a backhand shot, as well as to impart increased velocity to backhand shots.

Unitary Embodiments

Figure 3:
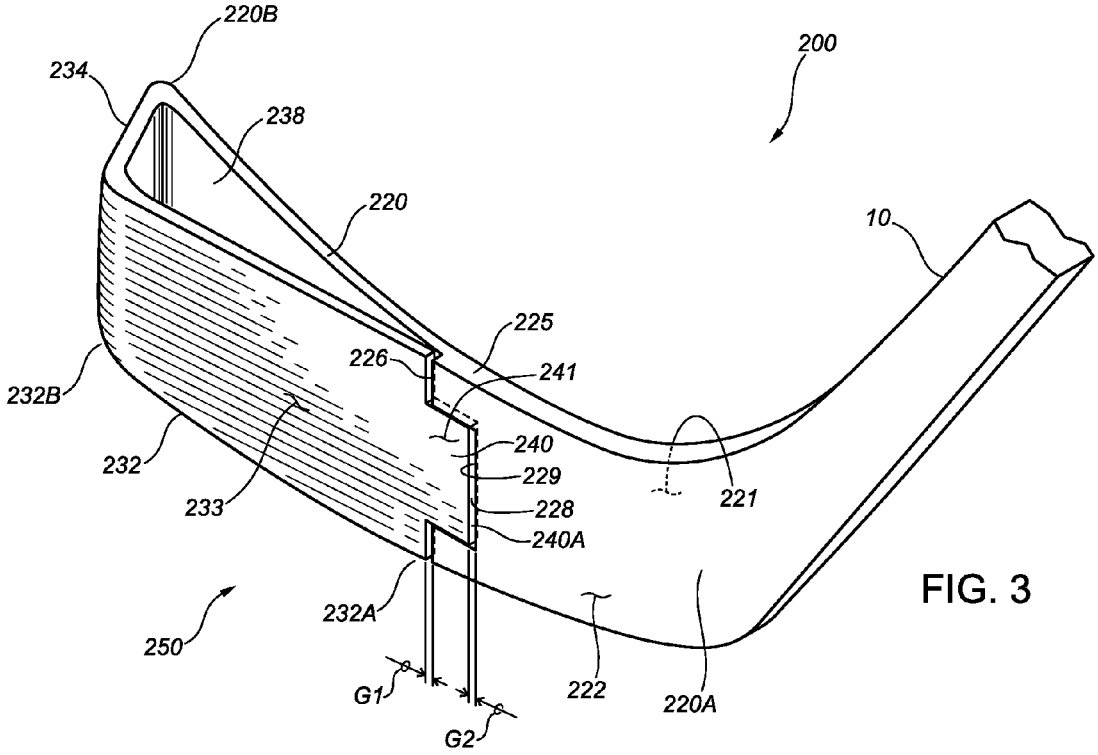
FIG. 3 is a perspective view of a unitary hockey stick blade assembly in accordance with second embodiment of the invention.
Figure 5:
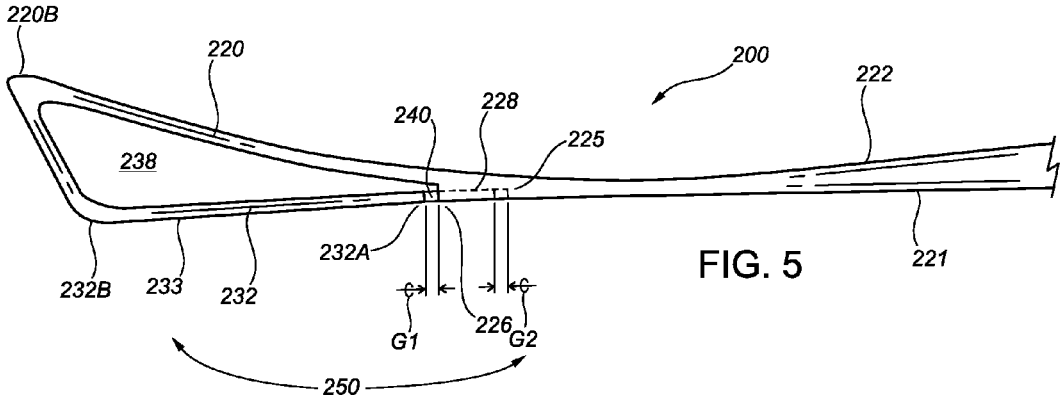
FIG. 5 is a plan view of the embodiment shown in FIG. 3.

FIGS. 3 and 5 illustrate a unitary hockey stick blade assembly 200 in accordance a second embodiment of the present invention, of unitary construction. Blade assembly 200 comprises a first (or forehand) blade member 220 having an inner (or heel) end 220A mountable to or integral with the lower end of an elongate shaft 10, and an outer (or toe) end 220B. Forehand blade member 220 has a first (or forehand) contact face 221 (which may be curved or straight) extending between heel end 220A and toe end 220B, and a second (or back) face 222 extending from heel end 220A to a transition point 226 located between heel end 220A and toe end 220B.

The thickness of the portion of forehand blade member 220 between transition point 226 and toe end 220B is less than the thickness of the portion of forehand blade member 220 between transition point 226 and heel end 220A, with a zone of comparatively greater thickness (or "thickened zone") 225 in a region of back face 222 adjacent to transition point 226. Formed into thickened zone 225 is a recess 228 extending a selected depth from back face 222, and extending laterally to an inner wall 229 at a selected distance from transition point 226 toward heel end 220A of forehand blade member 220. In the illustrated embodiment, recess 228 is a rectilinear recess located about mid-height of forehand blade member 220. However, this is by way of example only, and recess 228 may be provided in other geometric configurations without departing from the present invention.

At its toe end 220B, forehand blade member 220 is contiguous with a first end of a bridging member 234. A backhand blade member 232, having an inner (or heel) end 232A, and an outer (or toe) end 232B, and a backhand contact face 233, is contiguous at toe end 232B with a second end of bridging member 234. Formed integrally with backhand blade member 232, and projecting from heel end 232A thereof, is a tongue member 240 configured to fit into recess 228 in thickened zone 225 of forehand blade member 220, such that tongue member 240 can slide within recess 228 as forehand blade member 220 flexes during use. Tongue member 240 has an inner (or heel) end 240A, plus an outer surface 241 which smoothly transitions into backhand contact face 233 of backhand blade member 232. As shown, this construction forms a hollow space 238 bounded by backhand blade member 232, an opposing portion of forehand blade member 220, and bridging member 234.

Preferably, tongue member 240 has a cross-sectional thickness closely corresponding to the depth of recess 228, such that the contour (whether straight or curved) of outer surface 241 of tongue member 240 substantially matches the contours of adjacent areas of back face 222 forehand blade member 220. Accordingly, and as best seen in FIG. 5, backhand contact face 233 of backhand blade member 232, outer surface 241 of tongue member 240, and back face 222 of forehand blade member 220 combine to form an effectively continuous composite backhand contact surface 250 having a desired contour or configuration (i.e., straight or curved).

To allow lateral movement of tongue member 240 within recess 228 in response to flexure of forehand blade member 220, a first gap G1 is provided between heel end 232A of backhand blade member 232 and transition point 226, and a second gap G2 is provided between heel end 240A of tongue member 240 and inner wall 229 of recess 228. The sliding range of tongue member 240 within recess 228 will be determined by the lesser of gap G1 and gap G2. To optimize the effective continuity of composite backhand contact surface 250, gaps G1 and G2 may be made only as wide as necessary to accommodate anticipated flexure of forehand blade member 220. In alternative embodiments, however, either or both of gaps G1 and G2 may be greater than this ideal minimum width, without departing from the scope of the present invention.

Due to the change in thickness of forehand blade member 220 at transition point 226, the thinner outer section of forehand blade member 220 between transition point 226 and toe end 220B has less flexural stiffness than the thicker inner (i.e., heelward) section. This construction allows the outer section to be thinner than a typical conventional hockey stick blade of the same material (in accordance with well-understood structural engineering principles). More significantly from a player's standpoint, it allows the outer section to flex to a greater degree than would otherwise be the case, so as to give a forehand shot increased velocity off forehand contact face 221, as well as enhanced puck-aiming control, due to the incremental spring-like force delivered to the puck as the flexed outer section of forehand blade member 220 elastically rebounds as the puck leaves forehand contact face 221.

In the particular embodiment shown in FIGS. 3 and 5, heel end 232A of backhand blade member 232 is not attached to forehand blade member 220 at transition point 226 but is slidable relative to forehand blade member 220. However, in variants of this embodiment, heel end 232A of backhand blade member 232 could be attachable to, attached to, or integrally connected with forehand blade member 220 at transition point 226, as may be desirable for hockey players who prefer a stiffer or less flexible blade. Such variant embodiments would not require recess 228 and tongue member 240.

It will be readily appreciated by those skilled in the art that various modifications of the present invention may be devised without departing from the scope and teaching of the present invention, including modifications which may use equivalent structures or materials hereafter conceived or developed. It is to be especially understood that the invention is not intended to be limited to any described or illustrated embodiment, and that the substitution of a variant of a claimed element or feature, without any substantial resultant change in the working of the invention, will not constitute a departure from the scope of the invention. It is also to be appreciated that the different teachings of the embodiments described and discussed herein may be employed separately or in any suitable combination to produce desired results.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element. Any use of any form of the terms "connect", "affix", "couple", "mount", "attach", "bond", or any other term describing an interaction between elements is not meant to limit the interaction to direct interaction between the subject elements, and may also include indirect interaction between the elements such as through secondary or intermediary structure.

What is claimed is:

1. A hockey stick blade assembly comprising:

(a) a forehand blade member having a heel end adapted for connection to an elongate shaft, a toe end, a forehand contact face, and a back face;

(b) a backhand blade member having a heel end, a toe end, a backhand contact face, and an inner face; and (c) a bridging member having a first end connected to the toe end of the forehand blade member and a second end connected to the toe end of the backhand blade member;

wherein the heel end of the backhand member is disposed adjacent the back face of the forehand blade member, thereby forming a hollow zone bounded by the bridging member, the back face of the forehand member, and the inner face of the backhand member, said hollow zone being open at its upper and lower ends.

2. A hockey stick blade assembly as in claim 1 wherein the heel end of the backhand member is slidable relative to the forehand blade member, in a direction toward or away from the heel end of the forehand blade member.

3. A hockey stick blade assembly as in claim 1 wherein the heel end of the backhand member is non-slidingly connected to the forehand blade member.

4. A hockey stick blade assembly as in claim 1, wherein said hockey stick blade assembly further comprises an auxiliary member having:

(a) a heel end;

(b) a toe end contiguous with the first end of the bridging member;

(c) an outer face; and (d) an inner face;

wherein said outer face of the auxiliary member is affixed to the back face of the forehand blade member.

5. A hockey stick blade assembly as in claim 4 wherein the heel end of the backhand blade member is slidable relative to the forehand blade member, in a direction toward or away from the heel end of the forehand blade member.

6. A hockey stick blade assembly as in claim 4 wherein the heel end of the backhand blade member is non-slidably connected to the forehand blade member.

7. A hockey stick blade assembly as in claim 1 wherein the backhand blade member comprises one or more materials selected from the group consisting of wood, fibreglass, and carbon fiber.

8. A hockey stick blade assembly as in claim 1 wherein the hockey stick blade assembly is of unitary construction.

9. A hockey stick blade assembly as in claim 1 wherein:

(a) the back face of the forehand blade member defines a transition point where the thickness of the forehand blade member changes, so as to define a thickened zone adjacent to the transition point and extending toward the heel end of the forehand blade member;

(b) the thickness of the forehand blade member in a region extending from the transition point toward the toe end of the forehand blade member is less than the thickness of said thickened zone;

(c) a recess extends to a selected depth from the back face of the forehand blade member into the thickened zone, and extends laterally a selected distance from the transition point toward the heel end of the forehand blade member; and (d) the heel end of the backhand blade member defines a tongue member disposed within the recess in the thickened zone, such that the tongue is slidable within the recess in a direction toward or away from the heel end of the forehand blade member.

10. A hockey stick blade assembly as in claim 9 wherein the transverse thickness of the tongue member is substantially equal to the depth of the recess.

11. A hockey stick blade assembly as in claim 9 wherein the tongue member is of rectilinear configuration.

12. A hockey stick blade assembly as in claim 9 wherein the hockey stick blade assembly is of unitary construction.

13. A hockey stick comprising:

(a) an elongate shaft having an upper end and a lower end; and (b) a hockey stick blade assembly as in claim 1, wherein the heel end of the forehand blade member of said hockey stick blade assembly is attached to the lower end of the elongate shaft.

14. A backhand adapter comprising:

(a) a backhand blade member having a heel end, a toe end, a backhand contact face, and an inner face;

(b) an auxiliary member having a heel end, a toe end, an outer face, and an inner face; and (c) a bridging member having a first end and a second end; wherein:

(d) the first end of the bridging member is contiguous with the toe end of the backhand blade member;

(e) the second end of the bridging member is contiguous with the toe end of the auxiliary member;

(f) the backhand adapter is mountable to a hockey stick blade by affixing the outer face of the auxiliary member to a selected face of the hockey stick blade; and (g) when the backhand adapter is mounted to the hockey stick blade, the heel end of the backhand blade member will lie adjacent to said selected face of the hockey stick blade.

15. A backhand adapter as in claim 14, wherein the backhand blade member comprises one or more materials selected from the group consisting of wood, fibreglass, and carbon fiber.

* * * * *